US006805753B2

(12) United States Patent
Cary et al.

(10) Patent No.: US 6,805,753 B2
(45) Date of Patent: Oct. 19, 2004

(54) METHOD TO SEPARATE SILICONE SEAL BY THERMAL DEGRADATION

(75) Inventors: Karen Cary, Louisville, KY (US); Michael Schulz, Chattanooga, TN (US); Tom Dooley, Calhoun, GA (US)

(73) Assignee: Schott Corporation, Yonkers, NY (US)

( * ) Notice: Subject to any disclaimer, the term of this patent is extended or adjusted under 35 U.S.C. 154(b) by 0 days.

(21) Appl. No.: 10/686,056

(22) Filed: Oct. 14, 2003

(65) Prior Publication Data

US 2004/0074522 A1 Apr. 22, 2004

Related U.S. Application Data

(60) Provisional application No. 60/418,374, filed on Oct. 15, 2002.

(51) Int. Cl.[7] ..... B08B 7/00

(52) U.S. Cl. ..... 134/19; 134/2; 134/17; 134/25.2; 134/34; 134/35; 134/42; 126/1 R; 126/39 R; 126/39 H; 126/211; 126/217

(58) Field of Search ..... 126/1 R, 39 R, 126/39 H, 211, 217, 218; 134/19, 2, 17, 25.2, 34, 35, 42

(56) References Cited

U.S. PATENT DOCUMENTS 4,047,977 A * 9/1977 Yoshida et al. ..... 148/264
4,312,571 A * 1/1982 Ganzhorn ..... 134/2
6,455,819 B1 * 9/2002 Pohl et al. ..... 219/452.12
6,652,665 B1 * 11/2003 Sachdev et al. ..... 134/26
2002/0000239 A1 * 1/2002 Sachdev et al. ..... 134/2
2002/0018885 A1 * 2/2002 Takahashi et al. ..... 428/328
2003/0140918 A1 * 7/2003 Tapian et al. ..... 126/39 R
2004/0074522 A1 * 4/2004 Cary et al. ..... 134/19

* cited by examiner

*Primary Examiner*—Sharidan Carrillo
(74) *Attorney, Agent, or Firm*—Volpe and Koenig, P.C.

(57) ABSTRACT

A method for removing silicone sealant from glass-ceramic surfaces is provided. The method includes heating the sealant to a temperature greater than 325 degrees Celsius so that it thermally degrades and then, mechanically removing the sealant from the glass-ceramic surface. A method of salvaging a glass-ceramic cooking surface from a cooktop including silicone sealant between a cooktop frame and the glass-ceramic cooking surface is also provided. If a defect is detected in the cooktop during manufacturing or distribution, the entire cooktop is heated to a predetermined temperature to allow the silicone sealant to be easily removed without using a knife or other potentially damaging devices. Once the silicone sealant is removed, the glass-ceramic cooking surface may be reused to produce another cooktop assembly.

7 Claims, 3 Drawing Sheets

FIG.1
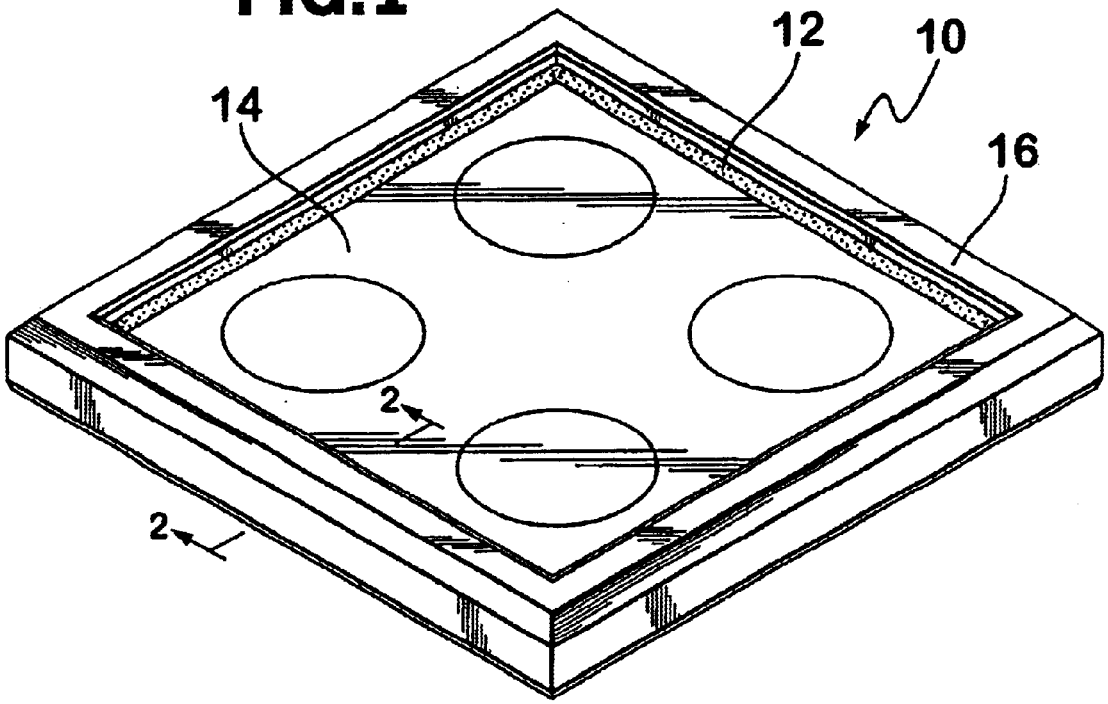
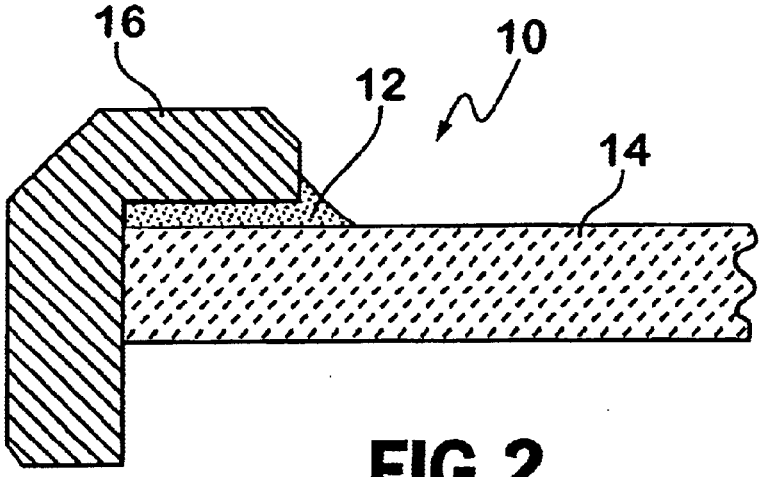
FIG.2

FIG.3
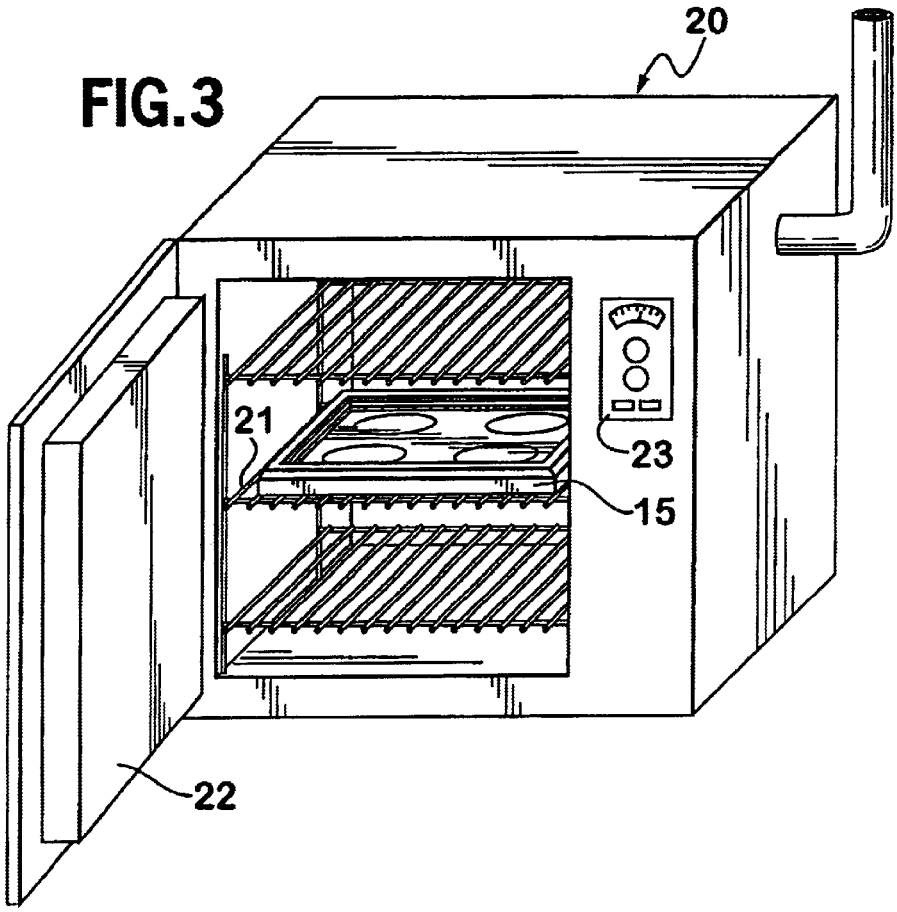
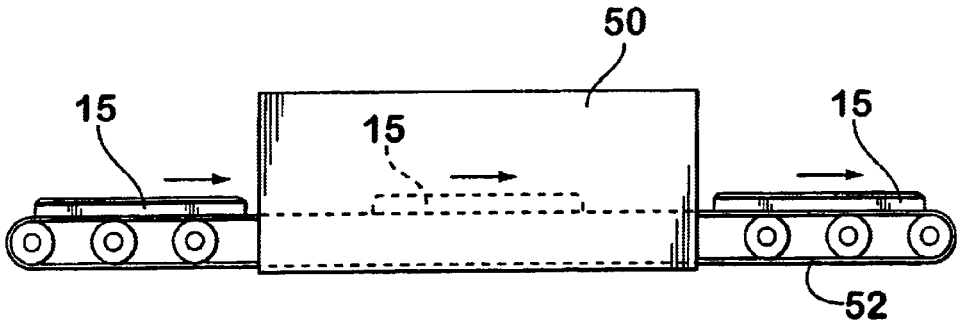
FIG.4

METHOD TO SEPARATE SILICONE SEAL BY THERMAL DEGRADATION

CROSS REFERENCE TO RELATED APPLICATION

This application claims the benefit of U.S. Provisional Patent Application No. 60/418,374, filed Oct. 15, 2002, which is incorporated by reference herein as if fully set forth.

BACKGROUND

Silicone sealants are used to form a watertight seal around glass-ceramic cooktops for the appliance industry as shown in FIG. 1. The silicone sealant 12 is dispensed around the cooktop 10 between the glass-ceramic cooking surface 14 and the frame 16 and prevents water from seeping under the cooktop and damaging the electrical components. The sealant also acts as an adhesive to bond the glass-ceramic cooking surface 14 to the frame 16. Since the seal is visible to the consumer, it must be smooth, uniform and free from defects.

During the assembly process, some of the cooktops do not meet the quality requirements due to uneven, torn seals or inadequate sealant. In order to lower the overall manufacturing cost, units with defective seals may be salvaged. It is also possible to salvage parts of the appliances which are damaged during the assembly, shipping, and handling processes, either internally or externally at the manufacturing facility. In all reject cases, the glass-ceramic top is preferably re-used in a new assembly in order to save costs, since the glass-ceramic is generally the most expensive component. The porcelain or plastic frame is discarded as is the sealing material. In order to re-use the glass-ceramic cooktop, it must be cleaned and free of all foreign materials such as sealant. Cured sealants are very strong and difficult to remove. The current method of cleaning the cured sealant from the glass includes cutting out the seal by running a blade along the length of the cooktop against the glass. The glass-ceramic is separated from the frame by inserting a knife blade between the backside of the glass and frame, and cutting along the length.

The current procedure is risky in that the knife could scratch the glass-ceramic material. Scratches on the backside of the glass-ceramic weaken it, leaving it susceptible to breakage later. Even scratches too small for the technician to see can weaken the strength of the glass-ceramic. A further problem in using a knife to clean the surface of the glass-ceramic is the possible safety hazards associated with this operation.

SUMMARY

The present invention provides a method for removing silicone sealant from glass-ceramic surfaces. The method includes heating the sealant to a temperature greater than 325 degrees Celsius and then, preferably, mechanically removing the sealant from the glass-ceramic surface.

The present invention further provides a method of salvaging a glass-ceramic cooking surface from a cooktop including silicone sealant between a frame of the cooktop and the glass-ceramic cooking surface. When during manufacturing or distribution a defect is detected in the cooktop, the defective cooktop is heated to a predetermined temperature to allow the silicone sealant to be easily removed without using a knife or other potentially damaging devices. Once the silicone sealant is removed, the glass-ceramic cooking surface and/or the cooktop frame may be reused in another cooktop assembly.

BRIEF DESCRIPTION OF THE DRAWINGS

This invention will be described with reference to the attached drawings. In these drawings:

FIG. 1 is a perspective view of a cooktop for practice of methods in accordance the present invention.

FIG. 2 is a partial sectional front view of the cooktop of FIG. 1.

FIG. 3 is a perspective view of an oven for separating silicone sealant from surfaces in accordance with the present invention.

FIG. 4 is a profile view of a tunnel oven for separating silicone sealant from surfaces in accordance with the present invention.

DETAILED DESCRIPTION OF THE PREFERRED EMBODIMENT

Figure 5:
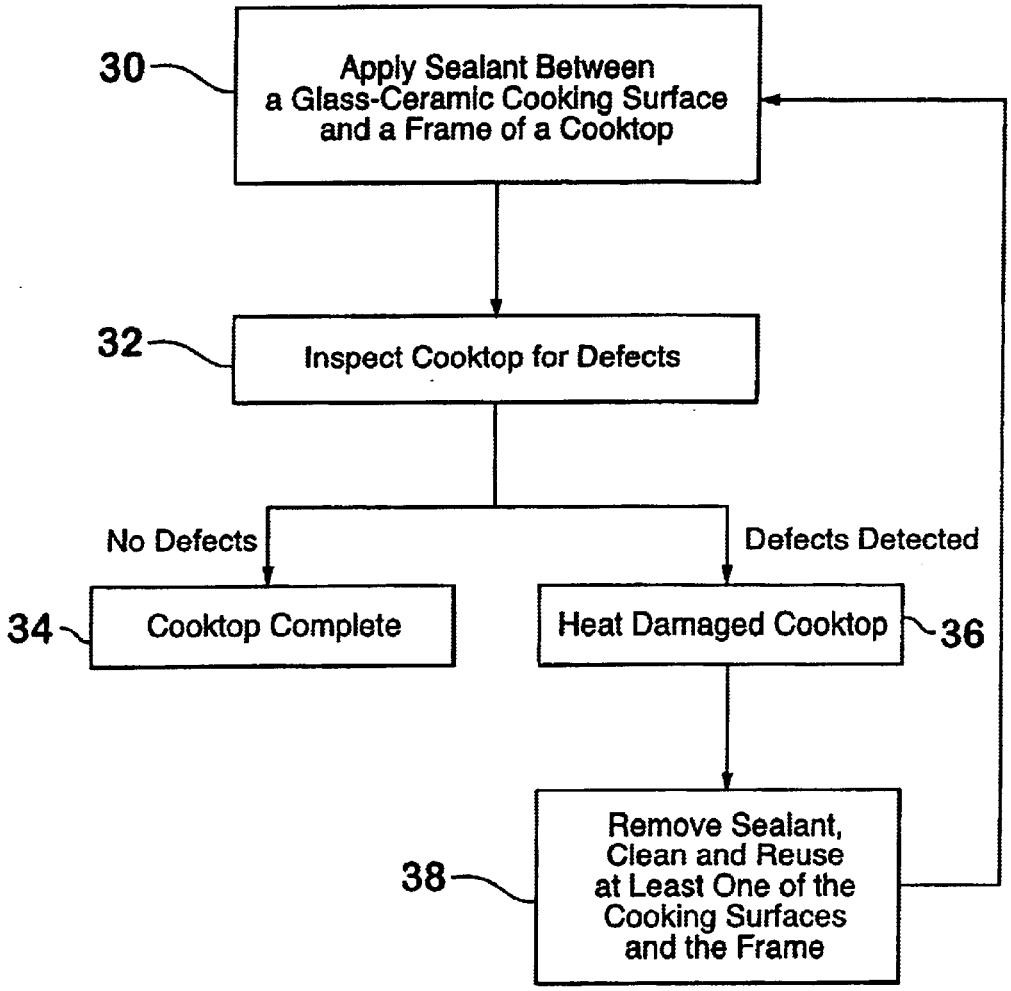
FIG. 5 is a flow diagram depicting a method for manufacturing cooktops in accordance with the present invention.

FIGS. 1 and 2 respectively show a perspective and a partial sectional view of a cooktop 10 for which the preferred method of the present invention can be used. The cooktop 10 includes a glass-ceramic cooking surface 14 and a frame 16. A cured silicone sealant 12, of the type known in the art, provides both a seal and adhesion between the frame 16 and the surface 14.

In accordance with the preferred embodiment of the present invention, a method is provided for removing the silicone sealant 12 from the glass-ceramic surface 14 and frame 16 without the use of a knife or any other scrapping tool, by heating the sealant 12 and the surrounding area to alter the sealant's physical and chemical properties. The cured silicone sealant 12 is a cross-linked elastomer at room temperature, and its adhesion strength to non-porous surfaces is essentially unaffected by temperatures less than approximately 200° C. At higher temperatures, a full degradation of polymer occurs. At very high temperatures, the sealant chars and becomes white flaky ash.

Table 1 summarizes the results of tests performed to optimize the heating schedule for thermally degrading and removing a silicone sealant. When the silicone sealant 12 is heated to 320° C., the sealant 12 is not sufficiently degraded, and is too sticky to remove without the use of a scraper or knife. At 375° C., the sealant 12 shrinks slightly and becomes slightly brittle; the glass-ceramic surface 14 can be easily separated from the frame 16 and both cleaned for re-use. At 420° C. and higher, the sealant 12 is charred and a white residue remains on the glass. At 600° C. the chemical structure of the silicone sealant 12 breaks down to highly oxidized components. Such highly oxidized components tend to leave a white ash and a visible film on the non-porous glass-ceramic surface 14.

TABLE 1

Tests to Remove Silicone Sealant By Thermal Degradation

| Temperature (° C.) | Time (minutes) | Observations |
|---|---|---|
| 320 | 30 | Seal very sticky, messy to remove |
| 375 | 30 | Seal shrank in volume, sealant material slightly Brittle, easy to remove, no white residue |

TABLE 1-continued

Tests to Remove Silicone Sealant By Thermal Degradation

| Temperature (° C.) | Time (minutes) | Observations |
|---|---|---|
| 420 | 30 | Some white ash, still messy |
| 600 | 60 | Thick white ash, very messy, visible film left on glass |

In accordance with the method of the preferred embodiment, the cooktop 10 with the attached silicone sealant 12 is heated to a temperature within the range of 325 to 425 degrees Celsius, and more preferably from 360 to 390 degrees Celsius, and most preferably 375 degrees Celsius, for a sufficient amount of time, preferably about 30 minutes, to break the cross-links in the sealant's polymer structure thereby destroying the adhesion provided by the sealant 12. The exact temperature ranges and time ranges that are required to remove a silicone sealant by thermal degradation from a non-porous glass-ceramic surface are dictated by the chemical composition of the cured sealant and by the physical characteristics of the sealant, such as its thickness and its exposed surface area. For most commercially available silicone sealants applied according to typical industry practice, a time period of 30–60 minutes at a temperature between 325 and 425 degrees Celsius is sufficient to adequately thermally degrade the cured sealant. It is important to note that the non-porous glass-ceramic surface 14 to which the silicone sealant 12 is adhered to is designed to withstand high temperatures, and is therefore not damaged by the heat treatment.

Preferably, mildly abrasive scrubbing pads applied with or without detergents are utilized to mechanically remove excess degraded sealant from salvaged cooktop components after heating. Alternatively, industrial washers using water, detergents and/or other suitable solvents may be used to clean the salvaged cooktop components. It is preferred to allow the cooktop components to cool prior to completing the cleaning process, depending on the method to be used to remove the degraded sealant. Since the glass-ceramic surface 14 is typically the most expensive component of the cooktop 10, the surface 14 is preferably cleaned and the frame 16 is preferably discarded.

An oven 20 for use in separating the sealant 12 from the glass-ceramic surface 14 in accordance with the invention is shown in FIG. 3. The oven 20 is equipped with a rack 21, a door 22 and a control panel 23. A damaged cooktop 15, substantially identical to the cooktop 10 of FIG. 1 is placed onto the rack 21, after which the door is closed, and the temperature is ramped up between 325 and 425 degrees Celsius. After a sufficient amount of time has passed, the hot cooktop 15 is removed from the oven 20. Alternatively, as shown in FIG. 4, a tunnel oven 50 may apply heat in a similar manner, allowing the damaged cooktop 15 to be carried through the oven 50 on a continuous conveyor 52. After heating, the glass-ceramic surface 14 is separated from the cooktop 15 and, if necessary, cleaned of excess sealant 12 in one of the above described manners. If other components of the damaged cooktop 15 are desired to be salvaged, for example the frame 16, they may also be cleaned.

FIG. 5 shows a flow chart of a method for manufacturing glass-ceramic cooktops of the type depicted in FIGS. 1 through 4. In an application step 30, a sealant 12 is applied between a glass-ceramic cooking surface 14 and a frame 16 to form a cooktop 10. Subsequently, in an inspection step 32 the completed cooktop 10 is inspected for defects. The inspection step preferably includes inspecting the cooktop 10 for defects relating to the application of the sealant, for example, that the sealant is applied smoothly without any discontinuities or breaks. If no defects are present in the assembled cooktop 10, the cooktop 10 is categorized as complete in a completion step 34. If defects are detected, in a heating step 36 the cooktop, now referred to as a damaged cooktop 15, is heated in one of the manners described above to thermally degrade the sealant 12. Following in a salvaging step 38, the cooking surface 14 and the frame 16 are separated from each other and the sealant is removed, then, either or both the cooking surface 14 and the frame 16 are cleaned and reused in a desired manner. Preferably, at least one of the glass-ceramic cooking surface 14 and the frame 16 are again utilized in the application step 30 at the start of the process.

While the preferred embodiment of the invention has been described in detail, the invention is not limited to the specific embodiment described above which should be considered as merely exemplary. Further modifications and extensions of the present invention may be developed and all such modifications are deemed to be within the scope of the present invention as defined by the appended claims.

What is claimed is:

1. A method for removing silicone sealant from a glass ceramic surface of a cooktop, the method comprising:

a) providing a cooktop having a glass ceramic surface and a silicone sealant;

b) heating the cooktop to a temperature greater than 325 degrees Celsius to thermally degrade the silicone sealant; and c) removing the silicone sealant from the cooktop.

2. The method according to claim 1, wherein the step of heating the cooktop includes the step of heating the cooktop to a temperature of approximately 375 degrees.

3. The method according to claim 1, wherein the step of heating the cooktop includes the step of heating the cooktop approximately between 325 degrees Celsius and 425 degrees Celsius, and allowing the sealant to thermally degrade.

4. The method according to claim 3, further wherein the step of removing the silicone sealant comprises mechanically removing the thermally degraded sealant from the cooktop.

5. The method according to claim 1, wherein the step of heating the cooktop includes the step of placing the cooktop on a conveyor through a tunnel oven.

6. The method according to claim 1, wherein the step of heating the cooktop includes the step of placing the cooktop in an oven having a containment area for receiving the cooktop and a door for isolating the article from an outside environment.

7. The method according to claim 1, wherein the step of heating the cooktop includes heating the cooktop for at least 20 minutes.

* * * * *